US008511269B2

(12) United States Patent
Reinhart et al.

(10) Patent No.: US 8,511,269 B2
(45) Date of Patent: Aug. 20, 2013

(54) CAMSHAFT SYSTEM FOR INTERNAL COMBUSTION ENGINE

(75) Inventors: Paul Reinhart, Livonia, MI (US); Raymond Puhl, Dearborn Hts., MI (US); John Pieprzak, Novi, MI (US)

(73) Assignee: Ford Global Technologies, Dearborn, MI (US)

( * ) Notice: Subject to any disclaimer, the term of this patent is extended or adjusted under 35 U.S.C. 154(b) by 1874 days.

(21) Appl. No.: 11/422,702

(22) Filed: Jun. 7, 2006

(65) Prior Publication Data

US 2007/0283913 A1 Dec. 13, 2007

(51) Int. Cl.
*F01M 1/06* (2006.01)

(52) U.S. Cl.
USPC ..... 123/90.34; 123/90.27; 123/90.33

(58) Field of Classification Search
USPC ..... 123/90.33, 90.34, 90.38, 90.15, 90.16, 123/90.17, 90.18, 193.3, 193.5; 29/898.041
See application file for complete search history.

(56) References Cited

U.S. PATENT DOCUMENTS

| | | | | |
|---|---|---|---|---|
| 4,199,202 | A | 4/1980 | Maeda | |
| 4,662,322 | A * | 5/1987 | Tamba et al. | 123/41.86 |
| 4,840,149 | A | 6/1989 | Fujita | |
| 4,957,079 | A * | 9/1990 | Nakatani et al. | 123/90.34 |
| 5,507,259 | A * | 4/1996 | Tanaka | 123/196 M |
| 6,260,526 | B1 * | 7/2001 | Kobayashi | 123/90.17 |
| 7,104,230 | B2 * | 9/2006 | Fujii et al. | 123/90.16 |
| 7,107,950 | B2 * | 9/2006 | Arinaga et al. | 123/90.16 |
| 2004/0089255 | A1 | 5/2004 | Lee | |

FOREIGN PATENT DOCUMENTS

| | | |
|---|---|---|
| DE | 3025876 A1 | 2/1981 |
| DE | 195 40 028 | 4/1997 |
| EP | 0 918 154 | 5/1999 |
| EP | 1 335 114 | 8/2003 |
| JP | 9-242511 | 9/1997 |
| JP | 8-74523 | 3/2006 |

OTHER PUBLICATIONS

Japanese Un-examined Utility Model Publication No. 62/8424, Jan. 19, 1987.*

* cited by examiner

*Primary Examiner* — Ching Chang
(74) *Attorney, Agent, or Firm* — Jerome R. Drouillard; Julia Voutyras

(57) ABSTRACT

A cylinder head for an internal combustion engine includes a casting having a number of camshaft support bulkheads. Each of the support bulkheads has a portion of a parent bore bearing for mounting a camshaft. A bulkhead thrust surface is formed in an outer surface of at least one of the support bulkheads. A camshaft is rotatably mounted upon the support bulkheads. The camshaft has at least one thrust bearing member abutting a bulkhead thrust surface which is provided with lubricating oil by means of a radially extending, surface-piercing lubricant distribution channel formed in the bulkhead thrust surface, such that oil flowing in the parent bearing will be caused to be deposited upon the bulkhead thrust surface as well as upon the camshaft thrust surface.

12 Claims, 3 Drawing Sheets

CAMSHAFT SYSTEM FOR INTERNAL COMBUSTION ENGINE

BACKGROUND OF THE INVENTION

1. Field of the Invention

The present invention relates to a camshaft mounted within an engine, and particularly to a camshaft mounted within the cylinder head of an internal combustion engine and having oil fed to the various camshaft bearing surfaces.

2. Disclosure Information

Camshafts have been used in internal combustion engines for many years. Typically, such camshafts have a number of lobes which actuate poppet valves for controlling gas exchange in the engine's cylinders. With the advent of valve timing control devices, the lubrication of camshafts has become more difficult because such valve timing control devices may, in certain cases, assert an axial thrust load against the camshaft. Such thrust loads, which were not encountered with prior art valvetrain architectures, have caused issues with lubrication of the camshaft's thrust surfaces. One method for avoiding excessive wear on a thrust surface is to increase the amount of oil flowing to the surface. Of course, it is desirable to obtain enhanced lubrication at an affordable cost to the engine manufacturer.

The present inventive camshaft system provides enhanced camshaft thrust bearing lubrication without adding variable cost to the engine.

SUMMARY OF THE INVENTION

A camshaft system for an internal combustion engine includes a cylinder head having a plurality of camshaft support bulkheads, with each of the support bulkheads having a portion of a parent bearing bore for mounting a camshaft. A bulkhead thrust surface is formed upon an outer surface of at least one of the support bulkheads. A camshaft is rotatably mounted upon the support bulkheads, with the camshaft having at least one camshaft thrust surface abutting the bulkhead thrust surface. At least one surface-piercing, radially extending lubricant distribution channel is formed in the bulkhead thrust surface. The camshaft bearing, including the thrust bearing, is supplied with lubricant by means of a lubricant supply passage extending through at least a portion of the camshaft, such that lubricant is supplied through the surface-piercing, radially extending lubrication distribution channel to the bulkhead thrust surface. Alternatively, a lubricant supply passage may extend through at least a portion of the support bulkhead.

In the event that severe axial loading is an issue in both axial directions of a camshaft, lubricant distribution channels and bulkhead thrust surfaces may be provided on both sides of either a single, or alternative, bulkheads, with the bulkhead thrust surfaces abutting separate camshaft thrust surfaces. In any event, the surface-piercing, radially extending lubricant distribution channels function such that oil flowing into the parent camshaft bearing will be caused to be deposited upon a bulkhead thrust surface, as well as upon the camshaft thrust surface. In this manner, excessive wear of the thrust surfaces will be avoided.

It is an advantage of the present camshaft system that enhanced thrust bearing lubrication may be provided without variable cost to the engine manufacturer, because the surface-piercing, radially extending lubrication distribution channels may be cored during the casting process. During subsequent machining of the bulkhead thrust surfaces it is simply not necessary to perform any additional machining operation upon the surface-piercing, radially extending lubrication distribution channels.

It is yet another advantage of the present camshaft system that a more cost effective parent bore type of bearing system may be used for mounting a camshaft, while at the same time promoting long life and robustness of the camshaft thrust bearing system.

Other advantages, as well as features and objects of the present invention will become apparent to the reader of this specification.

DETAILED DESCRIPTION OF THE PREFERRED EMBODIMENT

Figure 1:
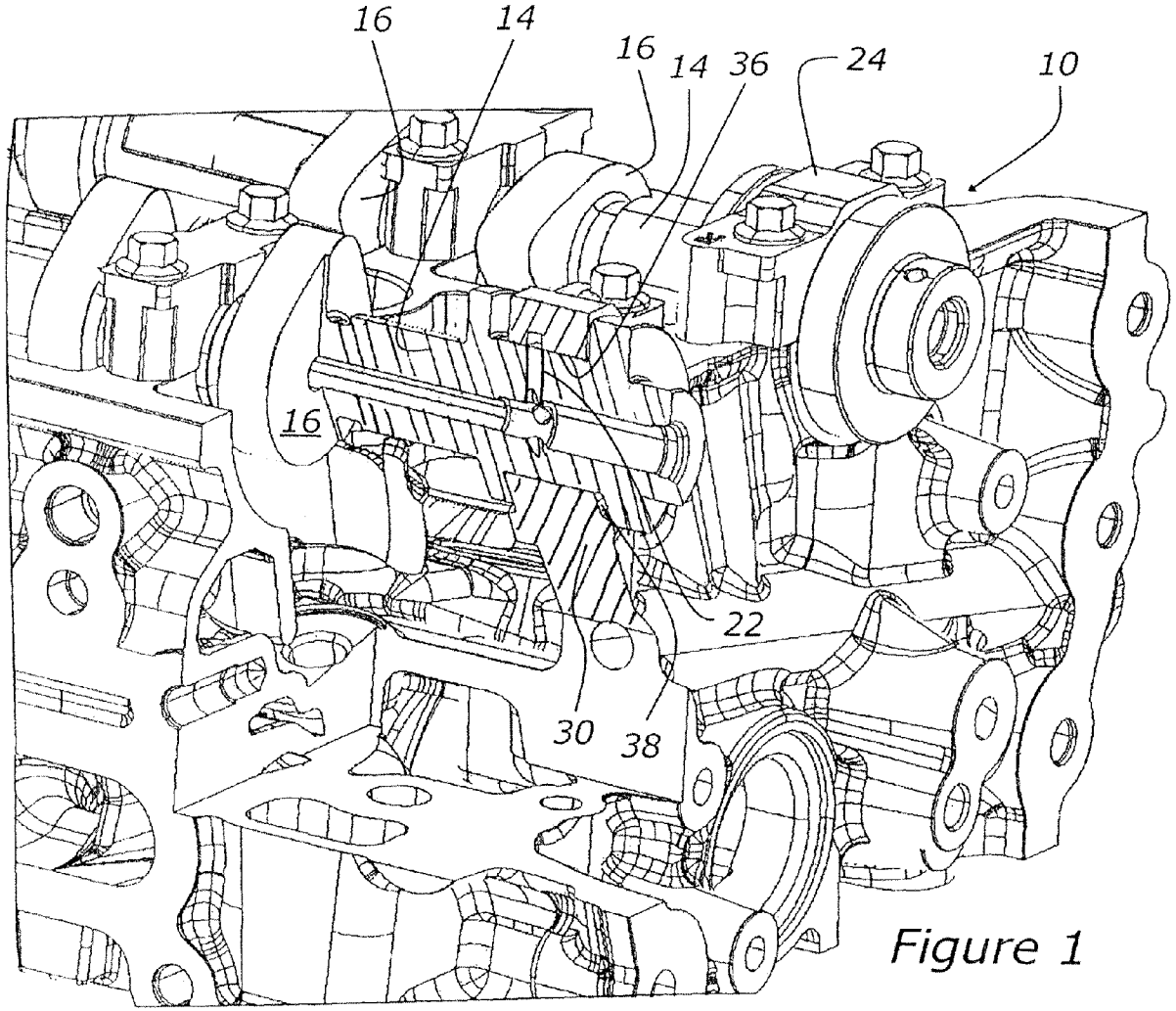
FIG. 1 is a perspective view, partially cut away, of a cylinder head having a camshaft assembled thereto according to the present invention.
Figure 3:
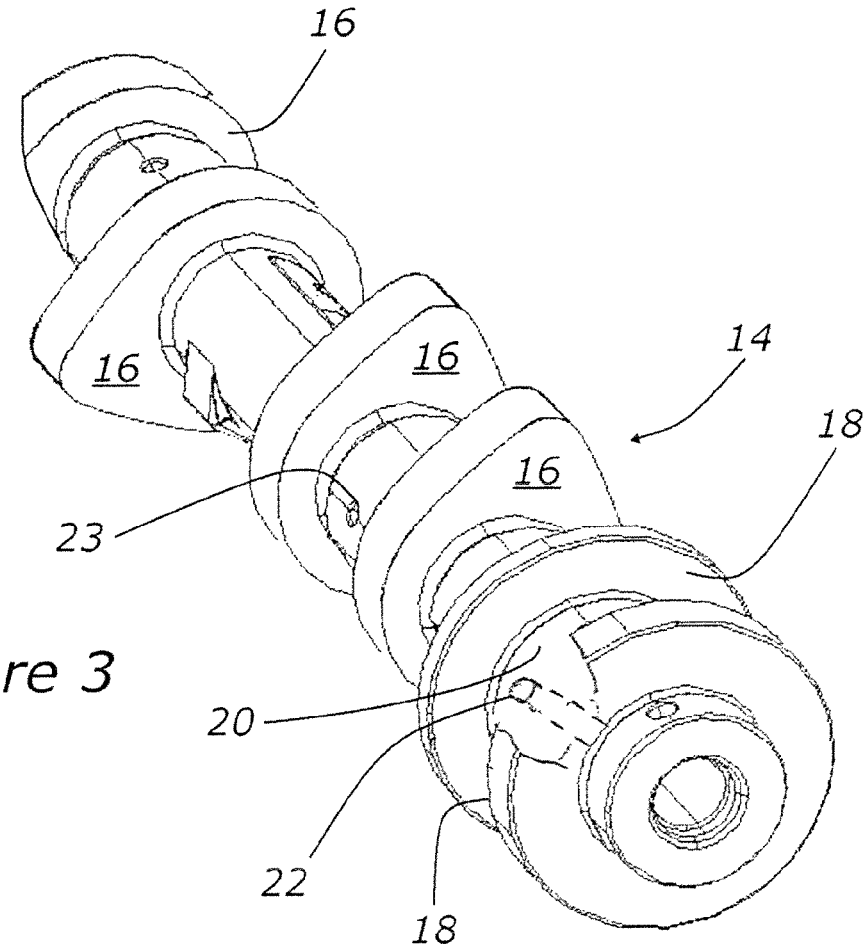
FIG. 3 is a perspective view, partially cut away, of a camshaft suitable for use with the present invention.

As shown in FIG. 1, cylinder head 10 has camshafts 14 mounted thereupon. Camshafts 14 each have a plurality of cam lobes, 16. As shown in FIG. 3, camshaft 14 has a number of camshaft thrust surfaces 18, which adjoin a cam journal, 20. Camshaft lubricant supply passage 22 provides lubrication to cam journal 20 from a passage connected with port 23. Camshaft 14 is maintained in contact with cylinder head 10 by means of camshaft caps 24 (FIG. 1).

Figure 2:
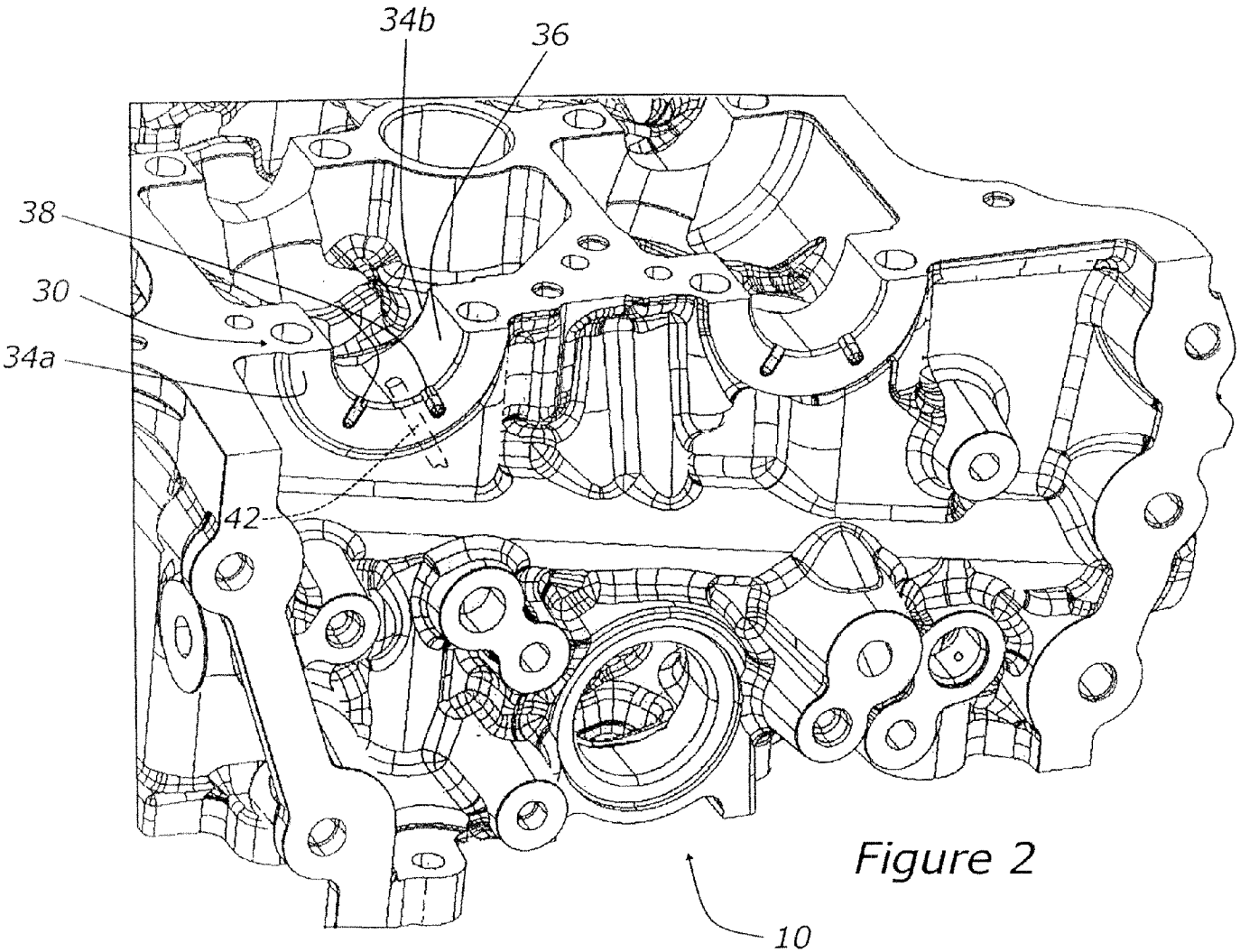
FIG. 2 illustrates a bare cylinder head casting having features according to one aspect of the present invention.

FIGS. 1 and 2 illustrate a number of camshaft support bulkheads, 30. At least one of camshaft support bulkheads 30 has at least one bulkhead thrust surface shown at 34*a* in FIG. 2. Bulkhead thrust surface is machined from the parent metal of bulkhead 30, as is the parent bearing bore, 36. Camshaft support bulkhead 30 also has at least one, and in the example illustrated in FIG. 2, at least two, surface-piercing, radially extending lubricant distribution channels 38. A single channel 38 is also shown in FIG. 1. Channels 38 are said to be surface-piercing because each channel has a semicircular sectional configuration opening onto the surface of one of bulkheads 30. Channels 38 extend radially only as far as the maximum diameter of camshaft thrust surfaces 18.

Channels 38 are preferably cored into camshaft support bulkheads 30 during the cylinder head casting process. If the lubrication distribution channels 38 are cored in, no machining, and therefore, no additional cost, is needed to produce the channels. Rather, the channels remain unaffected when bulkhead thrust surfaces 34*a* are finished during final machining of cylinder head 10. Alternatively, channels 38 may be formed by machining as with an end mill or slot drill.

Lubrication is provided to parent bearing 36 either by means of the bulkhead lubricant supply passage shown at 42 in FIG. 2, or by the interior lubricant supply passage shown at 22 in FIGS. 1 and 3. In either event, oil flowing into parent bearing 36 is provided to bulkhead thrust surfaces 34*a* and 34*b*, as well as to camshaft thrust surfaces 18. In this manner, each of the thrust surfaces will be prevented from wearing prematurely.

While particular embodiments of the invention have been shown and described, numerous variations and alternate embodiments will occur to those skilled in the art. Accordingly, it is intended that the invention be limited only in terms of the appended claims.

What is claimed is:

1. A camshaft system for an internal combustion engine, comprising:

a plurality of camshaft support bulkheads;

a bulkhead thrust surface formed upon an outer surface of at least one of said support bulkheads;

a camshaft rotatably mounted upon said support bulkheads, with said camshaft having at least one camshaft thrust surface abutting said bulkhead thrust surface; and at least one surface-piercing, radially extending lubricant distribution channel formed in said bulkhead thrust surface.

2. A camshaft system according to claim 1, further comprising a lubricant supply passage extending through at least a portion of said camshaft, such that lubricant is supplied through said surface-piercing, radially extending lubricant distribution channel to said bulkhead thrust surface.

3. A camshaft system according to claim 1, further comprising a lubricant supply passage extending through at least a portion of said at least one support bulkhead having a bulkhead thrust surface.

4. A camshaft system according to claim 1, wherein said camshaft support bulkheads are attached to a cylinder head.

5. A camshaft system according to claim 1, wherein said camshaft thrust surface has an annular configuration.

6. A camshaft system according to claim 1, wherein said camshaft is mounted directly to a parent bore formed at least in part by at least one of said camshaft support bulkheads.

7. A camshaft system according to claim 1, wherein at least one of said camshaft support bulkheads has a first bulkhead thrust surface and a first surface-piercing lubricant distribution channel formed on a first side of said bulkhead, and a second bulkhead thrust surface and a second surface-piercing lubricant distribution channel formed on a second side of said bulkhead, with each of said first bulkhead thrust surface and said second bulkhead thrust surfaces abutting separate camshaft thrust surfaces.

8. A camshaft system according to claim 1, wherein said at least one surface-piercing, radially extending lubricant distribution channel comprises a passage having a generally semicircular sectional configuration.

9. A camshaft system according to claim 8, wherein said at least one surface-piercing, radially extending lubricant distribution channel is formed during casting of a cylinder head incorporating said camshaft support bulkheads.

10. A camshaft system according to claim 8, wherein said at least one surface-piercing, radially extending lubricant passage is formed by machining a cylinder head casting.

11. A cylinder head for an internal combustion engine, comprising:

a casting comprising a plurality of camshaft support bulkheads, with each of said support bulkheads having a portion of a parent bearing bore for mounting a camshaft;

a bulkhead thrust surface formed in an outer surface of at least one of said support bulkheads;

a camshaft rotatably mounted upon said support bulkheads, with said camshaft having at least one camshaft thrust surface abutting said bulkhead thrust surface; and at least one surface-piercing, radially extending lubricant distribution channel formed in said bulkhead thrust surface, such that oil flowing into said parent bearing will be caused to be deposited upon said bulkhead thrust surface, as well as upon said camshaft thrust surface.

12. A cylinder head according to claim 11, wherein said at least one surface-piercing, radially extending lubricant distribution channel is formed during molding of said casting, prior to machining of said bulkhead thrust surface.

* * * * *